US011471889B2

(12) United States Patent
Nagy et al.

(10) Patent No.: US 11,471,889 B2
(45) Date of Patent: Oct. 18, 2022

(54) SAMPLE ASSEMBLY

(71) Applicant: Gentueri Inc., Madison, WI (US)

(72) Inventors: Randolph James Nagy, Madison, WI (US); Todd Bakken, Madison, WI (US)

(73) Assignee: Gentueri Inc., Madison, WI (US)

( * ) Notice: Subject to any disclaimer, the term of this patent is extended or adjusted under 35 U.S.C. 154(b) by 298 days.

(21) Appl. No.: 16/579,018

(22) Filed: Sep. 23, 2019

(65) Prior Publication Data

US 2020/0094248 A1 Mar. 26, 2020

Related U.S. Application Data

(60) Provisional application No. 62/735,598, filed on Sep. 24, 2018.

(51) Int. Cl.
*B01L 3/00* (2006.01)

(52) U.S. Cl.
CPC ..... *B01L 3/50825* (2013.01); *B01L 3/502* (2013.01); *B01L 2200/0689* (2013.01); *B01L 2200/141* (2013.01); *B01L 2300/042* (2013.01); *B01L 2300/105* (2013.01)

(58) Field of Classification Search
CPC ..... B01L 3/50825; B01L 3/502; B01L 2200/0689; B01L 2200/141; B01L 2300/042; B01L 2300/105
See application file for complete search history.

(56) References Cited

U.S. PATENT DOCUMENTS

| | | | | |
|---|---|---|---|---|
| D296,241 | S | 6/1988 | Miskinis | |
| 4,753,358 | A * | 6/1988 | Virca | B01L 3/50825 215/230 |
| 5,012,941 | A | 5/1991 | Abrams et al. | |
| 5,114,003 | A | 5/1992 | Jackisch et al. | |
| D335,924 | S | 5/1993 | Nilsson | |
| 5,859,374 | A | 1/1999 | Mink et al. | |
| 6,299,842 | B1 | 10/2001 | Kozak et al. | |

(Continued)

FOREIGN PATENT DOCUMENTS

CN 201530203369 6/2015

OTHER PUBLICATIONS

Garvin et al., "The forensiX Evidence Collection Tube and Its Impact on DNA Preservation and Recovery", BioMed Research International, Sep. 19, 2013 vol. 2013 Article ID 105797 (7 Pages).

(Continued)

*Primary Examiner* — Samuel P Siefke
*Assistant Examiner* — Tingchen Shi
(74) *Attorney, Agent, or Firm* — Michael Best & Friedrich LLP

(57) ABSTRACT

A sample assembly includes a vial, a vial insert, and a sealing arrangement. The vial insert could be any combination of a sample chamber, a matrix, or a swab breaker configured to be positioned within the vial. The sealing arrangement includes a coupling portion and a cap assembly. The coupling portion defines a mounting channel sized to receive a portion of the vial. The coupling portion is configured to slidably couple to the vial. The cap assembly includes a desiccant cap. The desiccant cap is configured to couple to the vial to selectively form a sterile barrier between the sealing arrangement and the vial.

10 Claims, 22 Drawing Sheets

(56) References Cited

U.S. PATENT DOCUMENTS

| | | | | |
|---|---|---|---|---|
| D591,507 | S | 5/2009 | Mowe et al. | |
| D621,951 | S | 8/2010 | Bucholtz et al. | |
| 7,794,656 | B2 | 9/2010 | Liang et al. | |
| 7,854,895 | B2 * | 12/2010 | Gallagher | A61B 10/0045 422/553 |
| D644,337 | S | 8/2011 | Belfance et al. | |
| D650,629 | S | 12/2011 | Gilbert | |
| D659,848 | S | 5/2012 | TerMaat et al. | |
| D676,572 | S | 2/2013 | Tarriff | |
| 8,685,346 | B2 | 4/2014 | Logel et al. | |
| 8,932,542 | B2 | 1/2015 | Schaefer et al. | |
| D724,236 | S | 3/2015 | Motadel et al. | |
| 9,044,007 | B2 | 6/2015 | Sadler | |
| 9,052,254 | B2 | 6/2015 | Sangha | |
| 9,103,749 | B2 | 8/2015 | Nagy | |
| 9,217,697 | B2 | 12/2015 | U'Ren et al. | |
| D749,420 | S | 2/2016 | Kahlau | |
| 9,248,449 | B2 | 2/2016 | Knight | |
| D760,489 | S | 7/2016 | De La Torre et al. | |
| D795,448 | S | 8/2017 | Zhou et al. | |
| D856,148 | S | 8/2019 | Lucas, Jr. et al. | |
| 2003/0129738 | A1 | 7/2003 | Sorenson et al. | |
| 2007/0084735 | A1 * | 4/2007 | Lancesseur | B65D 43/164 206/204 |
| 2007/0114140 | A1 * | 5/2007 | Portier | B65D 51/30 206/204 |
| 2009/0095699 | A1 | 4/2009 | Milante | |
| 2009/0155838 | A1 | 6/2009 | Hale | |
| 2011/0062176 | A1 * | 3/2011 | Lourenco | B65D 51/30 220/810 |
| 2012/0045826 | A1 | 2/2012 | Yantz et al. | |
| 2013/0196841 | A1 | 8/2013 | Dobrowolski | |
| 2013/0213828 | A1 | 8/2013 | Chatterjee et al. | |
| 2013/0266492 | A1 | 10/2013 | Daub et al. | |
| 2015/0289856 | A1 | 10/2015 | Saqi et al. | |
| 2015/0291338 | A1 | 10/2015 | Chen | |
| 2017/0248498 | A1 | 8/2017 | Kendall et al. | |
| 2017/0335313 | A1 * | 11/2017 | Qian | C12N 15/1017 |

OTHER PUBLICATIONS

Bhambhani et al., "Selection of Containers/Closures for Use in Lyophilization Application: Possibilities and Limitations", American Pharmaceutical Review, May 1, 2010 (8 Pages).

Gentueri, SwabSaver, <http://www.gentueri.com/swabsaver> published date unknown. Retrieved on Feb. 23, 2020.

* cited by examiner

SAMPLE ASSEMBLY

CROSS REFERENCE TO RELATED APPLICATIONS

This application claims priority to U.S. Provisional Patent Application No. 62/735,598, filed Sep. 24, 2018, the entirety of which is hereby incorporated by reference.

TECHNICAL FIELD

The present disclosure relates to sample assemblies, methods of manufacture, and methods of use. In particular, the disclosure relates to sample assemblies including a sealing arrangement.

INTRODUCTION

Sample assemblies may be used to collect biological samples (e.g. saliva samples). During manufacture, components of the sample assembly may be sterilized to reduce the chance of contaminating the sample. A user may swab their inner cheek and eject or break-off the head of the swab into the sample assembly. Among other methods, the user may spit into the sample assembly. The user may secure the sample assembly to transport the sample to a laboratory for testing to be performed.

SUMMARY

In one aspect, a sample assembly is disclosed. An example sample assembly includes a vial that receives a vial insert, a sealing arrangement including a coupling portion and a cap assembly, the coupling portion defining a mounting channel sized to receive a portion of the vial, the coupling portion configured to slidably couple to the vial, and the cap assembly including a desiccant cap, the desiccant cap being configured to couple to the vial to selectively form a sterile barrier between the sealing arrangement and the vial.

In another aspect, a method of assembling a sample assembly is disclosed. The method comprising, receiving a vial, positioning a vial insert into the vial, heat stamping a small pore-sized disk on a lattice of a desiccant cap, thereby generating a sterile barrier device, sterilizing the vial insert, the sterile barrier device, the vial with ethylene oxide, providing a desiccant into a desiccant cap chamber of the desiccant cap, receiving a sealing arrangement including a coupling portion and a cap, after providing the desiccant into the desiccant cap chamber, coupling the sterile barrier device to the cap thereby generating a cap assembly, and coupling the sealing arrangement to the vial.

In yet another aspect, a method of using a sample assembly is disclosed. The method comprising, receiving a sample container including the sample assembly, providing a sample into a vial insert of the sample assembly, sealing the sample assembly with a sealing arrangement of the sample assembly, the sealing arrangement including a desiccant, and providing the sample to a testing lab.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
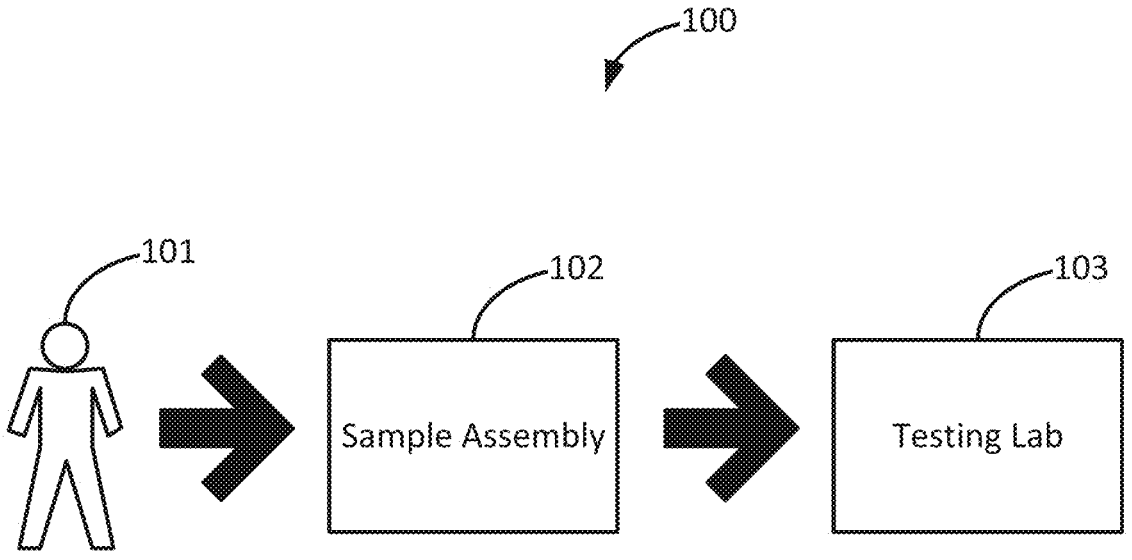
FIG. 1 shows an example sampling environment.

FIG. 1 is a schematic diagram of sampling environment 100. Sampling environment 100 includes user 101, sample assembly 102, and testing lab 103. The sampling environment 100 may be defined as the relationship between the user 101, the sample assembly 102, and testing lab 103 during a sampling process. The sampling environment may be at any location desired by the user 101. In some embodiments, the sampling environment 100 may begin at a house of the user 101 in order to provide convenience to the user 101. The user may access the sample assembly 102 and the sample assembly 102 may be transported to the testing lab 103. In other embodiments, the sampling environment 100 may begin and end with the user 101 and the sample assembly 102 in the testing lab 103.

The user 101 may access a sample assembly 102. The user 101 may be a person that desires a non-invasive sample to be taken for a variety of tests. In some embodiments, the user 101 may be a civilian that desires a DNA test to be performed. Among other embodiments, the user 101 may be a victim of sexual assault, a lab technician, a crime scene investigator, a doctor, a nurse, veterinarian, etc., that desires any test to be performed. The user 101 may access the sample assembly 102 in the testing lab 103 with the lab technician, the doctor, etc. Among other embodiments, the user 101 may receive the sample assembly 102 in a protected package at the user's desired location (e.g., a house).

The sample assembly 102 may be configured to receive a desired sample from the user 101. The user 101 may secure the sample assembly 102 to ensure the sample is protected from contamination, spilling, etc. The sample assembly 102 may include a DNA free chamber to allow for the sample to be secured without initial contamination occurring.

The testing lab 103 receives the sample assembly 102 and tests the sample provided by the user 101. The testing lab 103 may be a doctor's office, crime laboratory, an emergency room, a certified DNA testing lab, etc. In some embodiments, the sample from the user 101 may be a cheek swab that may be taken to a certified DNA testing lab 103. The sample that is provided by the user 101 may be determined by the desired test that will be performed on the sample. For example, the sample from the user 101 may be swab samples (e.g., buccal cells), secretion samples (e.g., saliva, sperm), tissue samples, etc. In some embodiments, the user 101 may desire the testing lab 103 to perform a DNA from a cheek swab to perform a paternity test, to establish ancestry, etc. Among other embodiments, the testing lab 103 may perform a sexual assault test with secretion samples (e.g. sperm) to determine if the incident can be confirmed.

Figure 2:
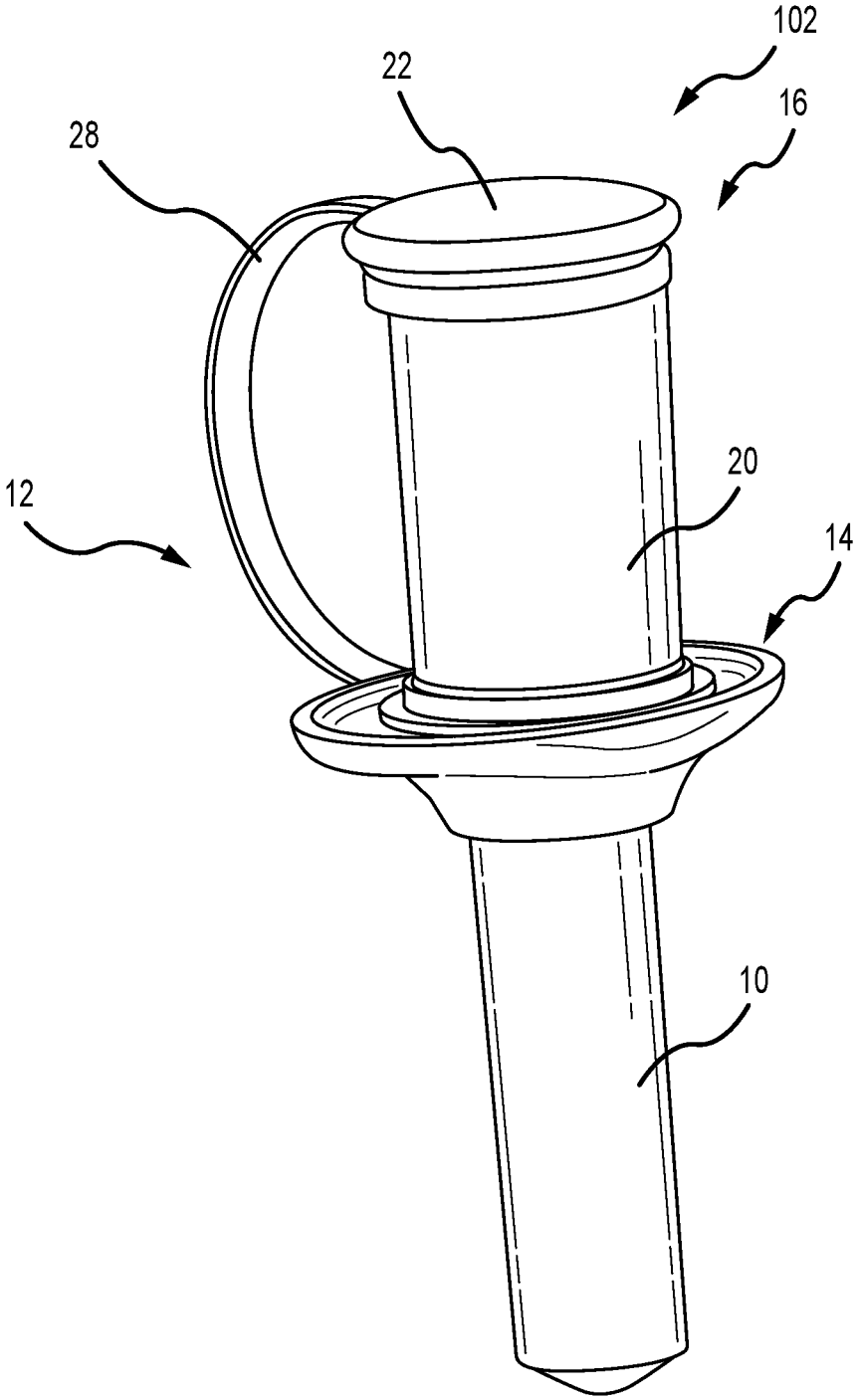
FIG. 2 is a perspective view of an embodiment of a sample assembly.
Figure 3:
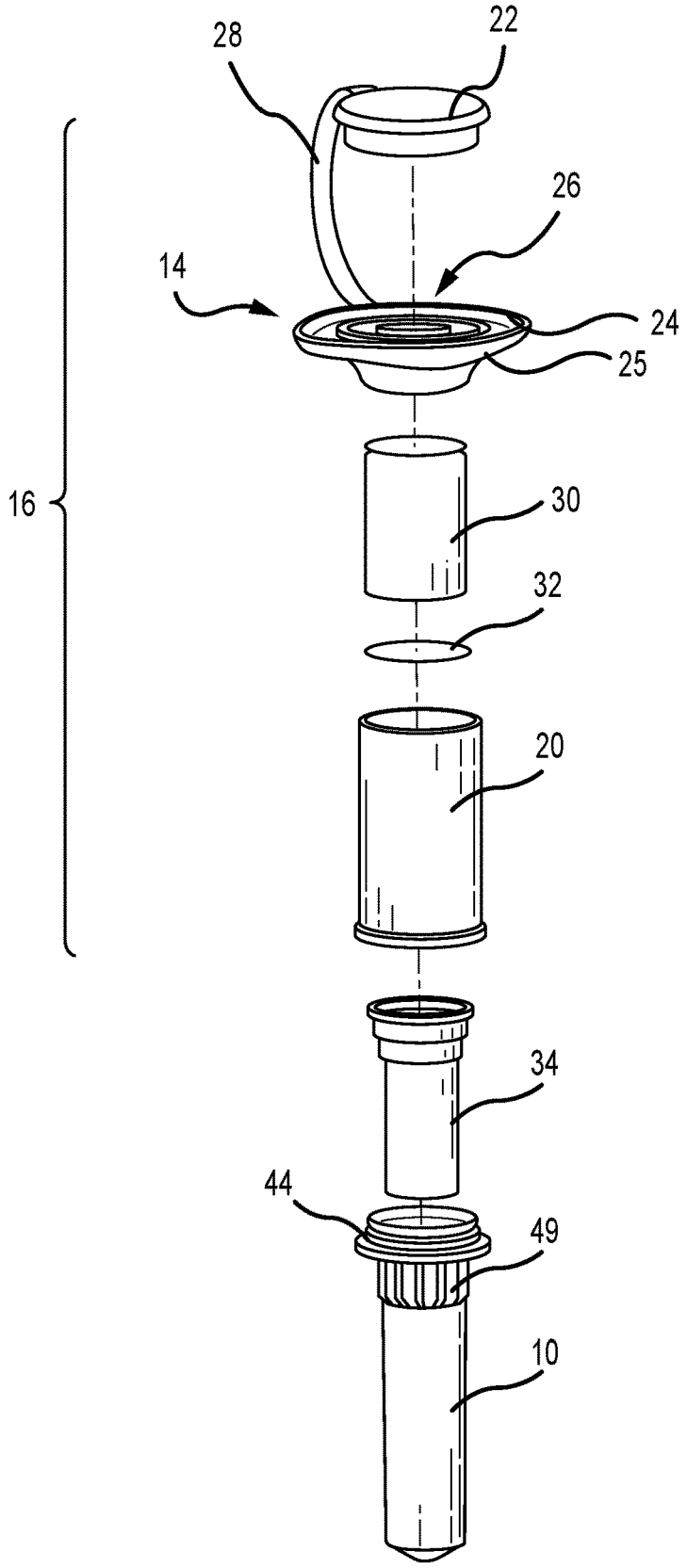
FIG. 3 is an exploded view of the sample assembly shown in FIG. 2 according to some embodiments.
Figure 4A:
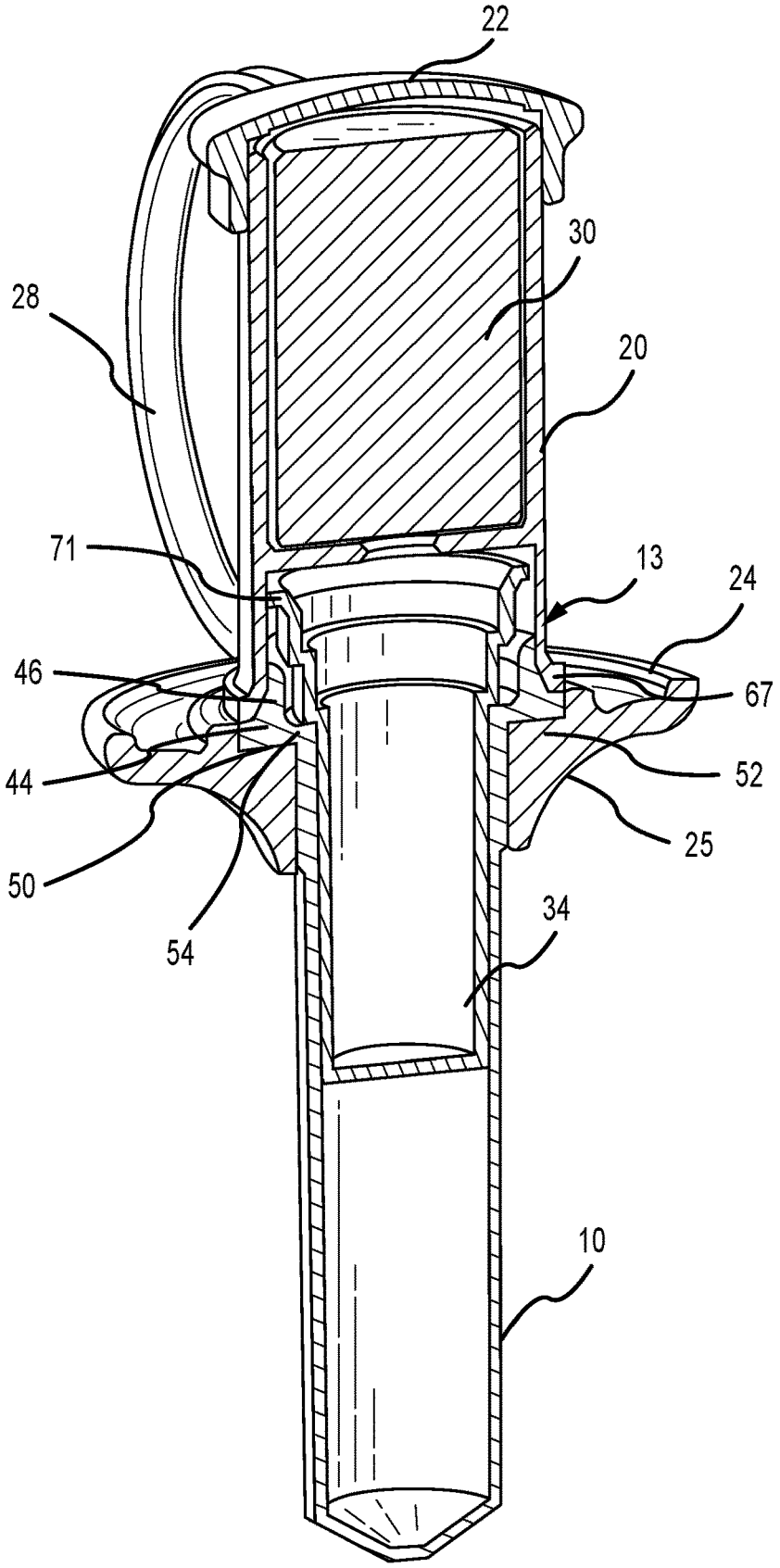
FIG. 4A is a cross-sectional view of the sample assembly of FIG. 2 according to some embodiments.
Figure 4B:
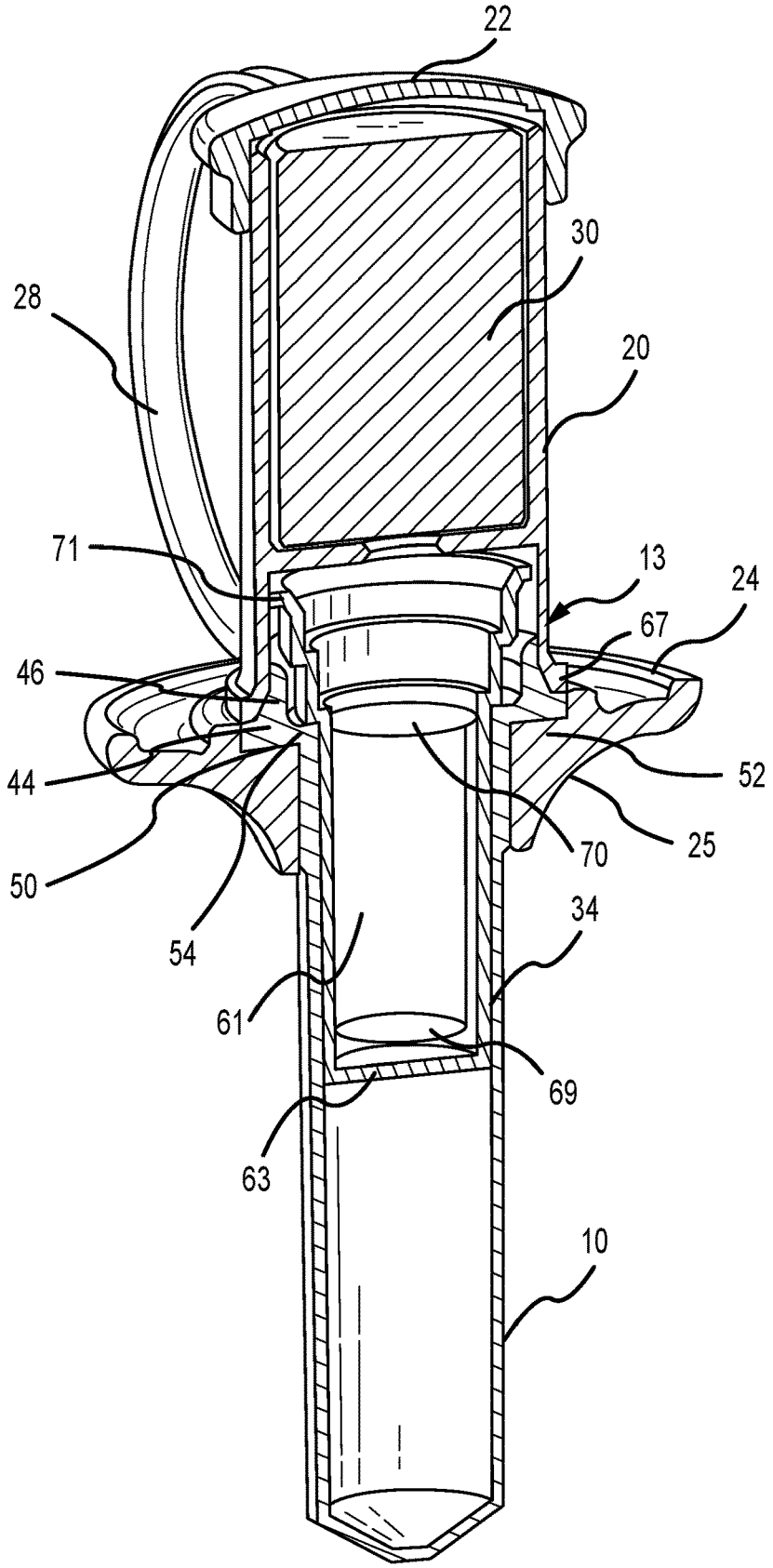
FIG. 4B is a cross-sectional view of the sample assembly of FIG. 2 according to some embodiments.
Figure 5A:
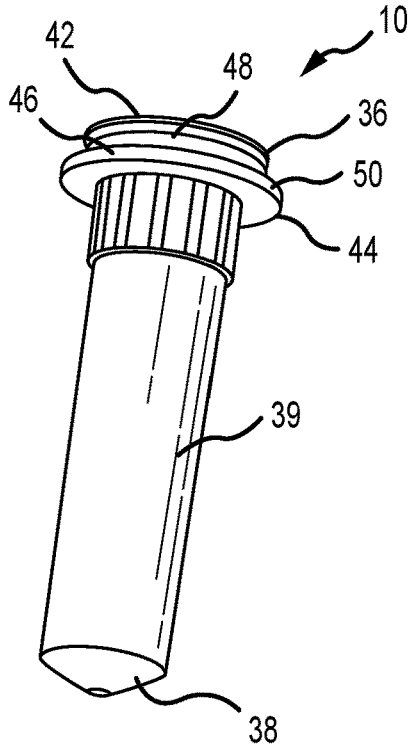
FIG. 5A is a perspective view of a vial shown in FIG. 2 according to some embodiments.
Figure 5B:
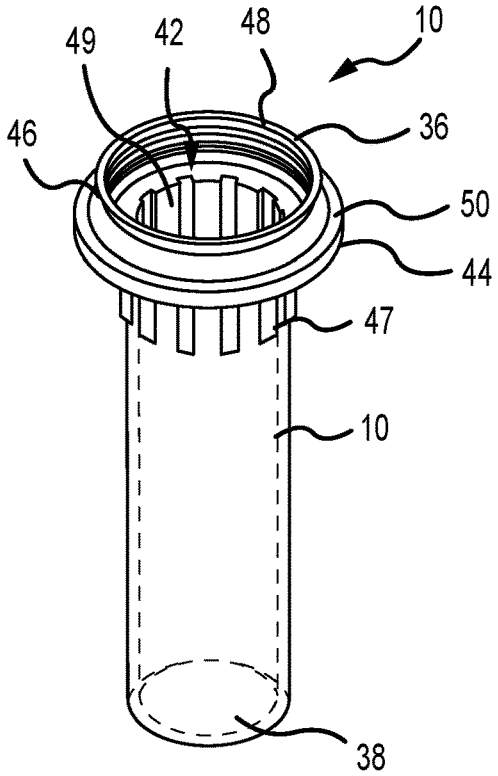
FIG. 5B is a translucent perspective view of the vial shown in FIG. 2 according to some embodiments.
Figure 6:
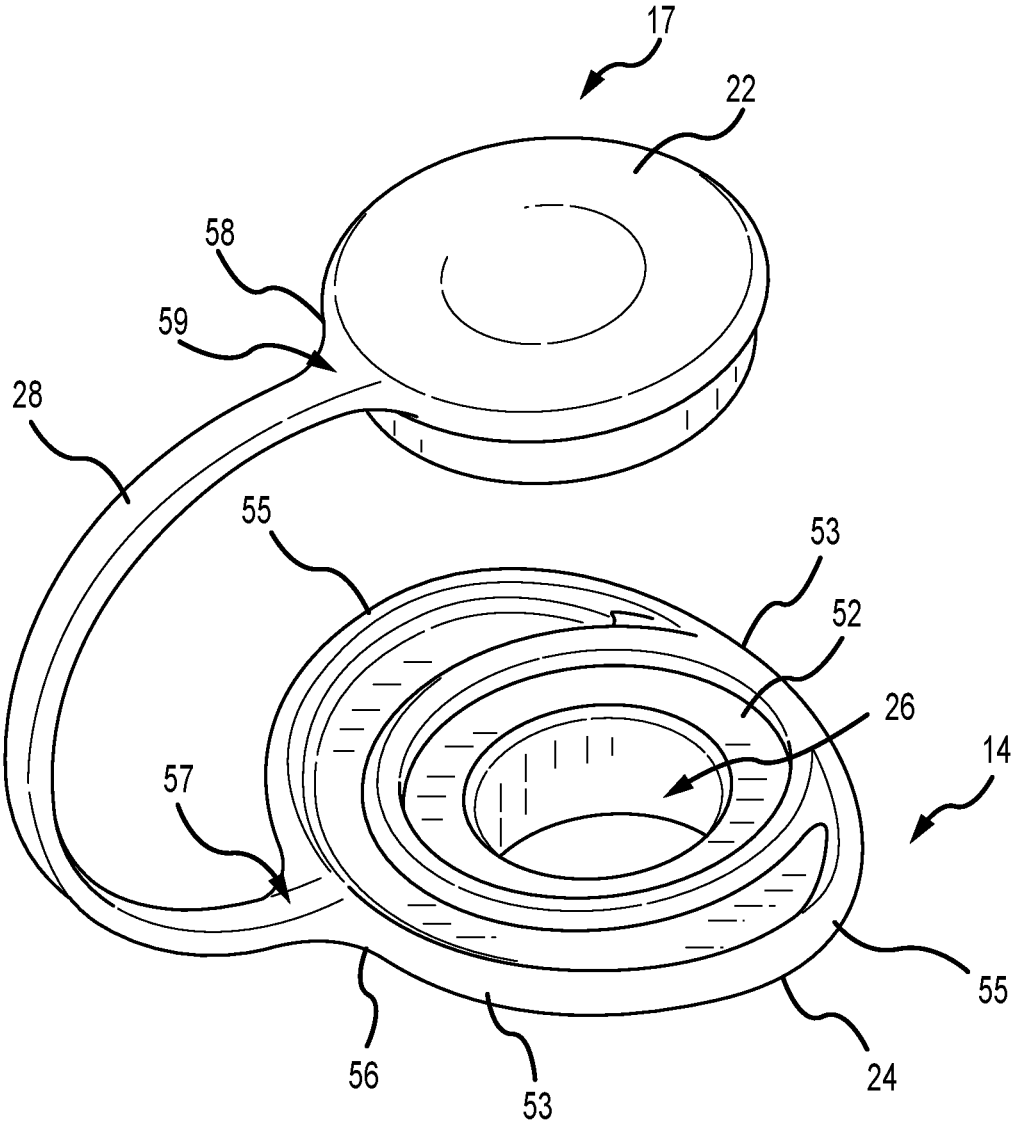
FIG. 6 is a perspective view of an embodiment of a sealing arrangement shown in FIG. 2 according to some embodiments.
Figure 7A:
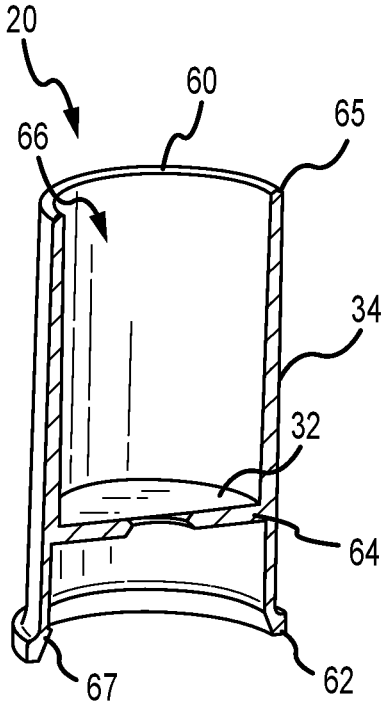
FIG. 7A is a perspective view of a desiccant cap shown in FIG. 2 according to some embodiments.
Figure 7B:
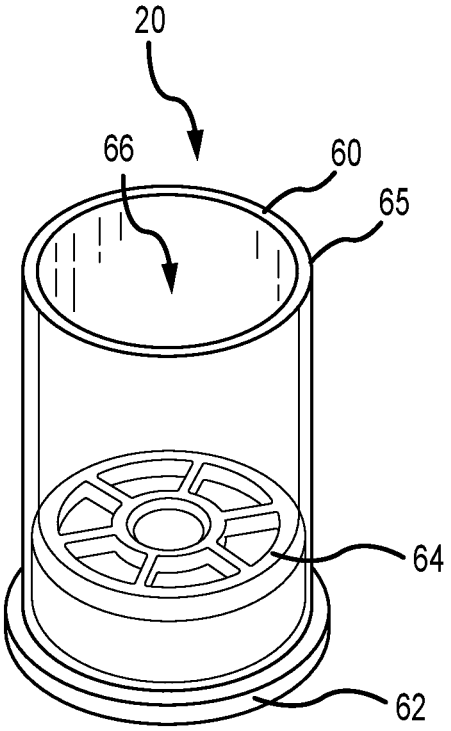
FIG. 7B is a translucent perspective view of the desiccant cap shown in FIG. 2 according to some embodiments.
Figure 8:
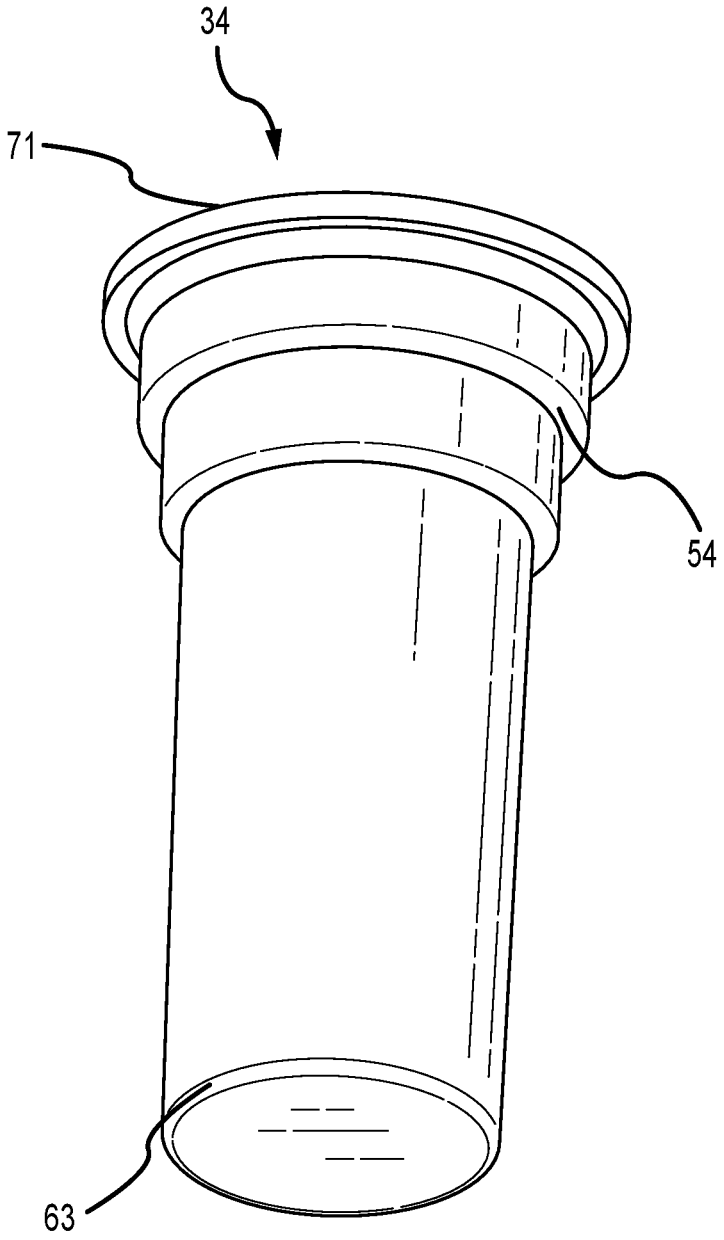
FIG. 8 is a perspective view of a sample chamber shown in FIG. 2 according to some embodiments.
Figure 9A:
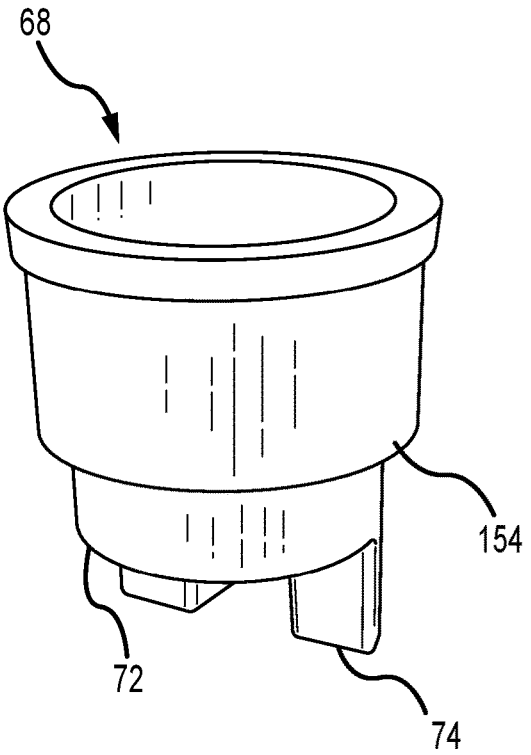
FIG. 9A is a perspective view of a swab breaker according to some embodiments.
Figure 9B:
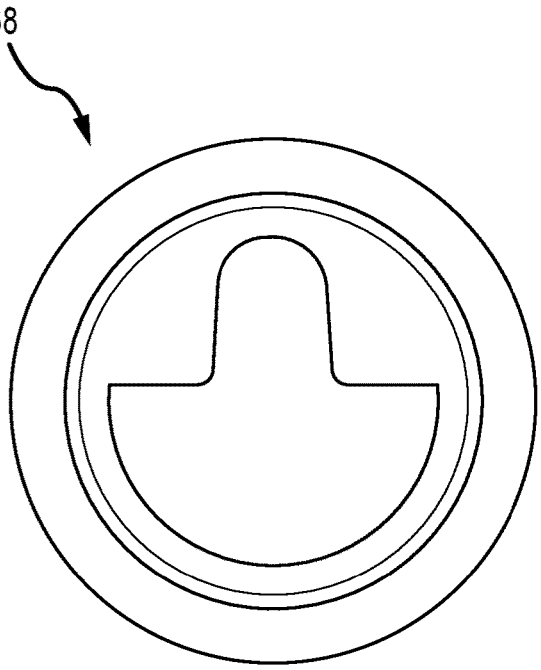
FIG. 9B is a top view of a swab breaker according to some embodiments.
Figure 9C:
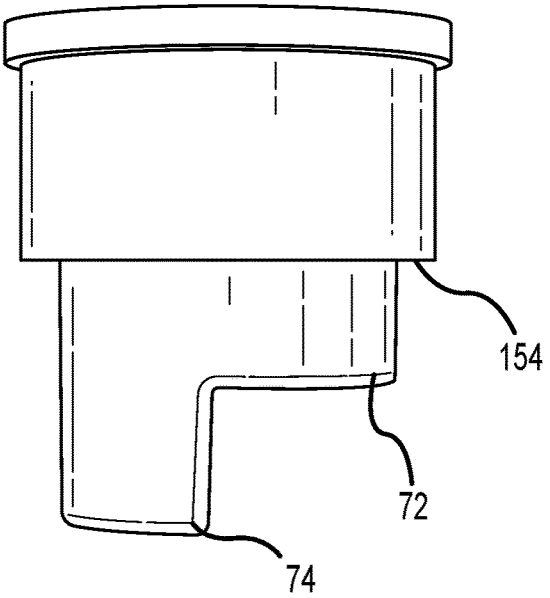
FIG. 9C is a side view of a swab breaker according to some embodiments.
Figure 10:
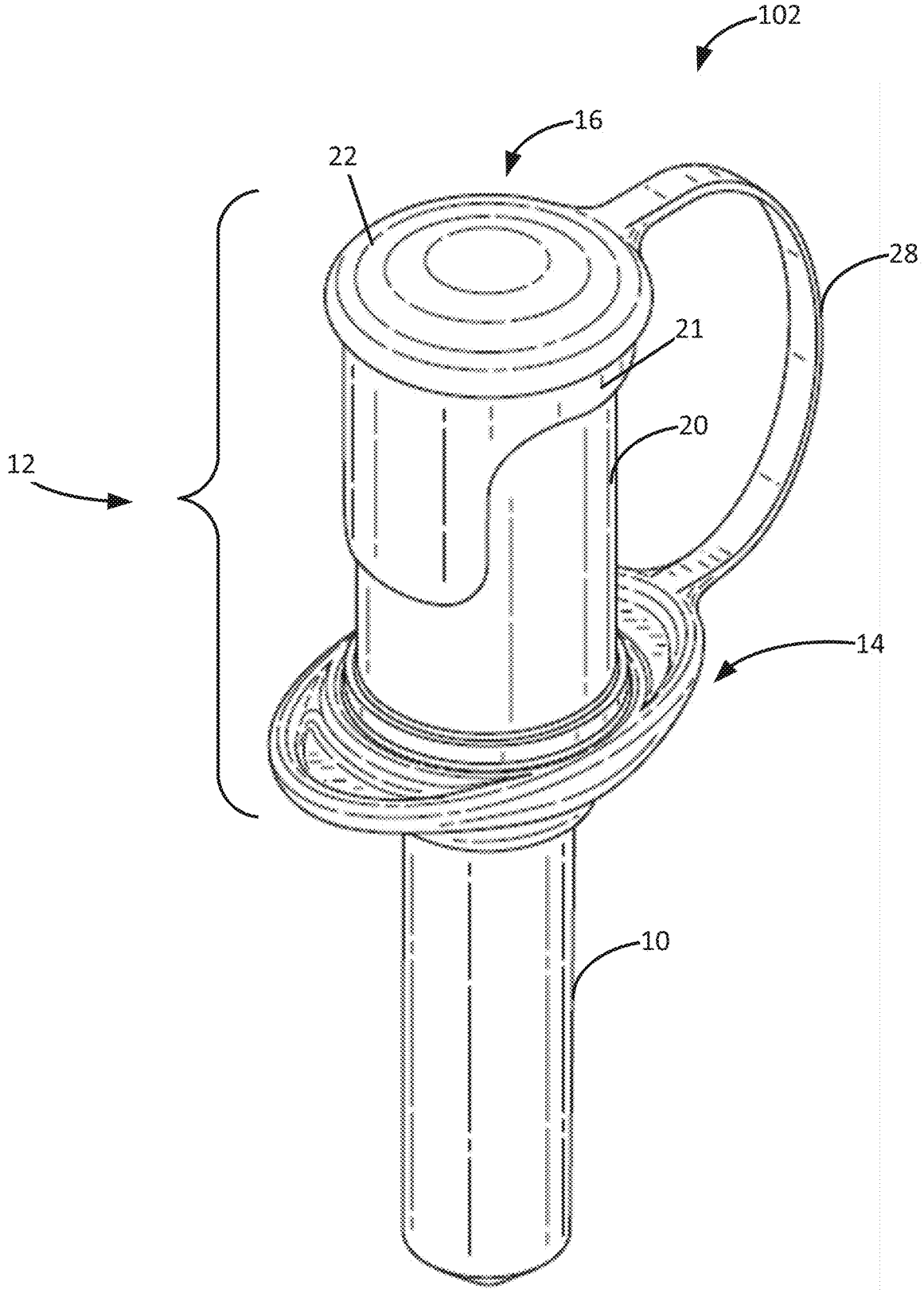
FIG. 10 is a front perspective view of another embodiment of a sampling assembly.
Figure 11:
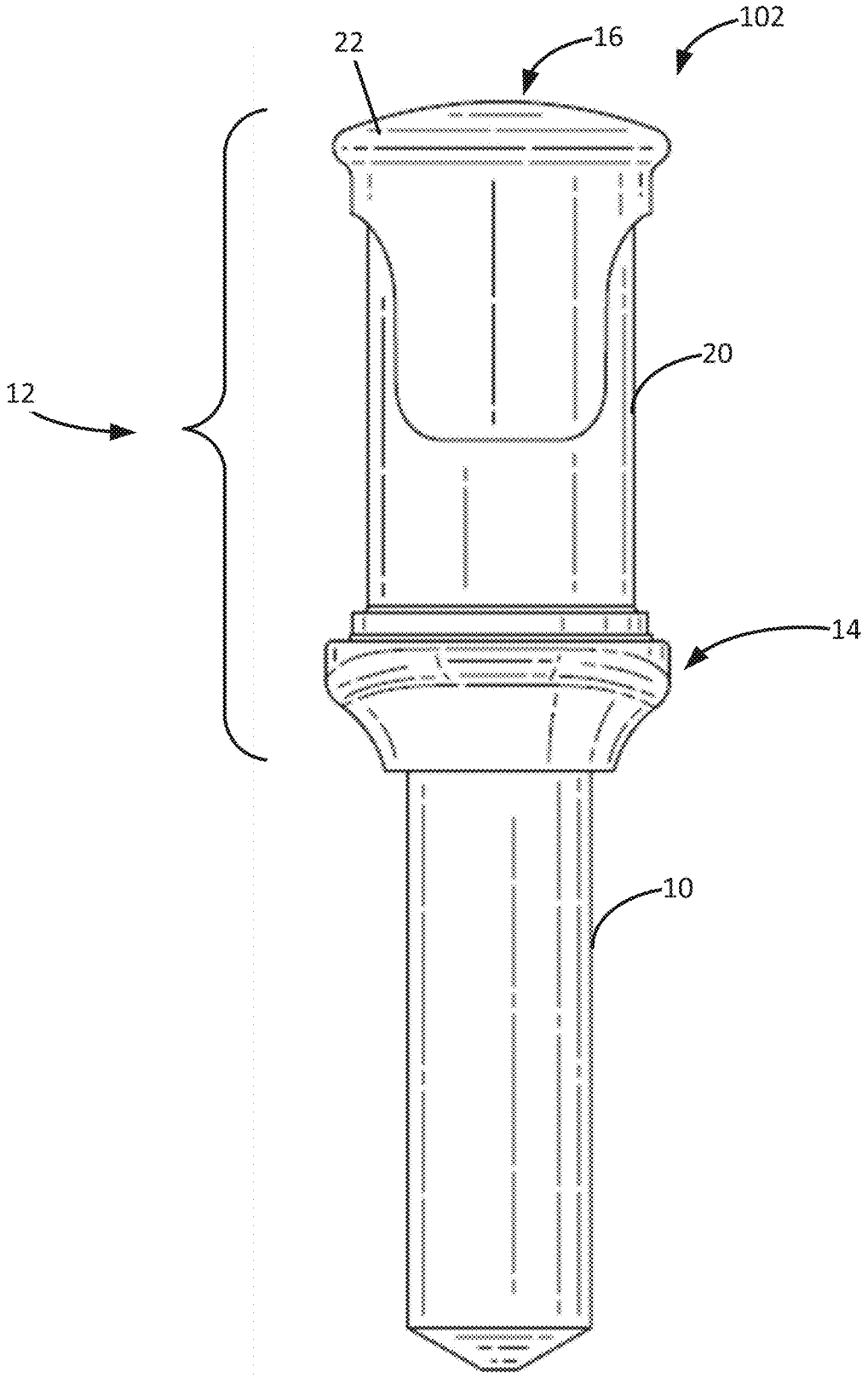
FIG. 11 is a front view of the sample assembly shown in FIG. 10 according to some embodiments.
Figure 12:
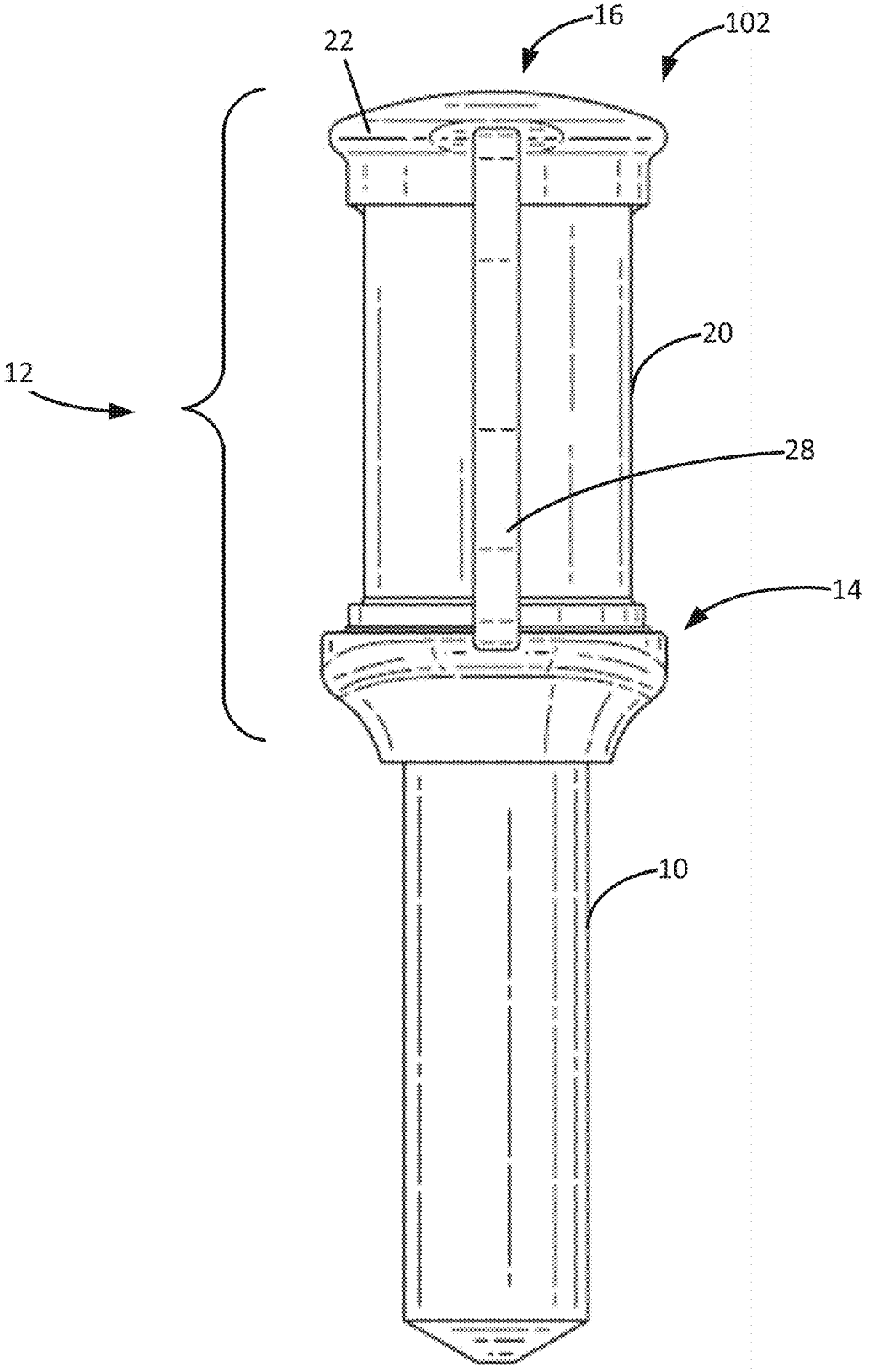
FIG. 12 is a rear view of the sample assembly shown in FIG. 10 according to some embodiments.
Figure 13:
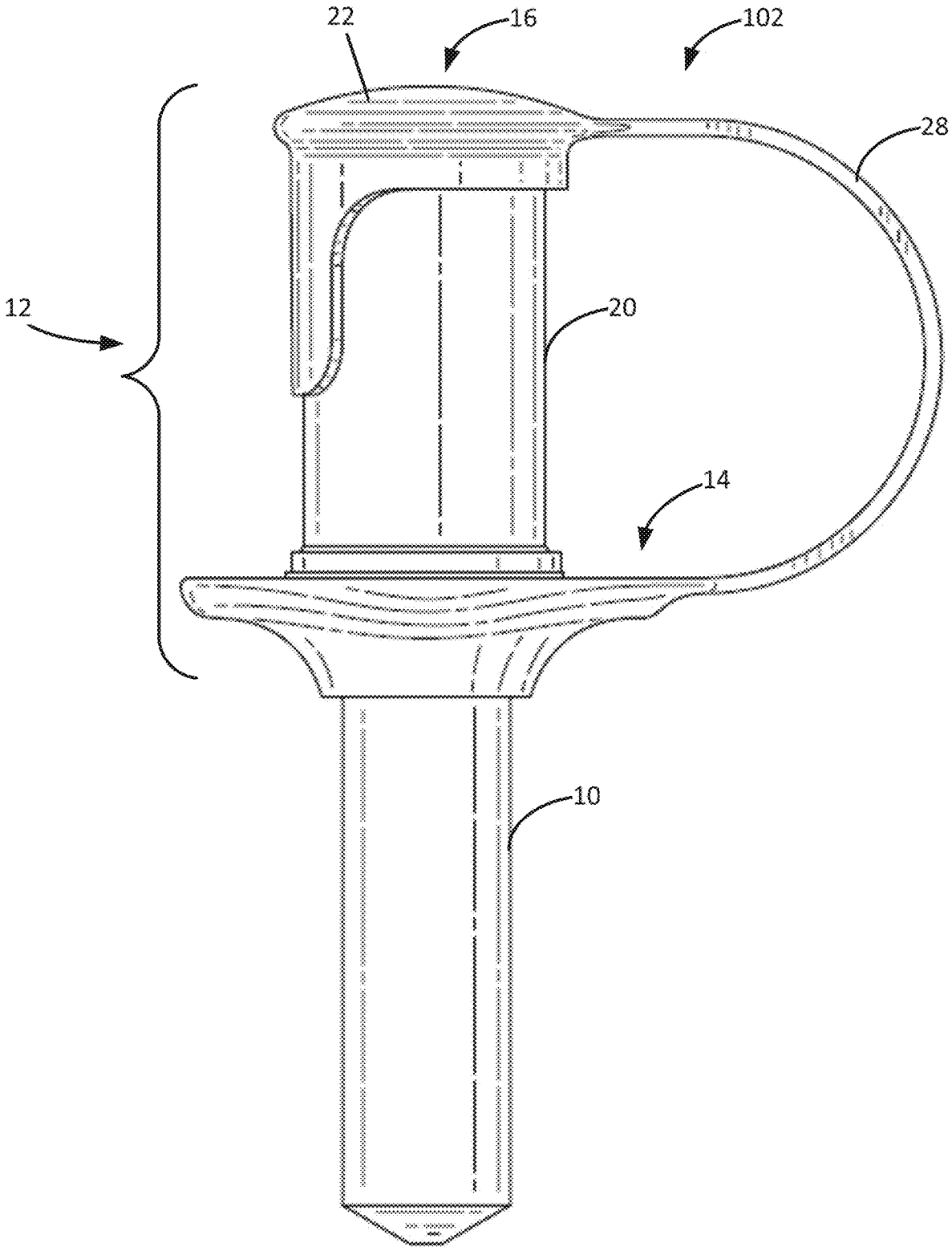
FIG. 13 is a right side view of the sample assembly shown in FIG. 10 according to some embodiments.
Figure 14:
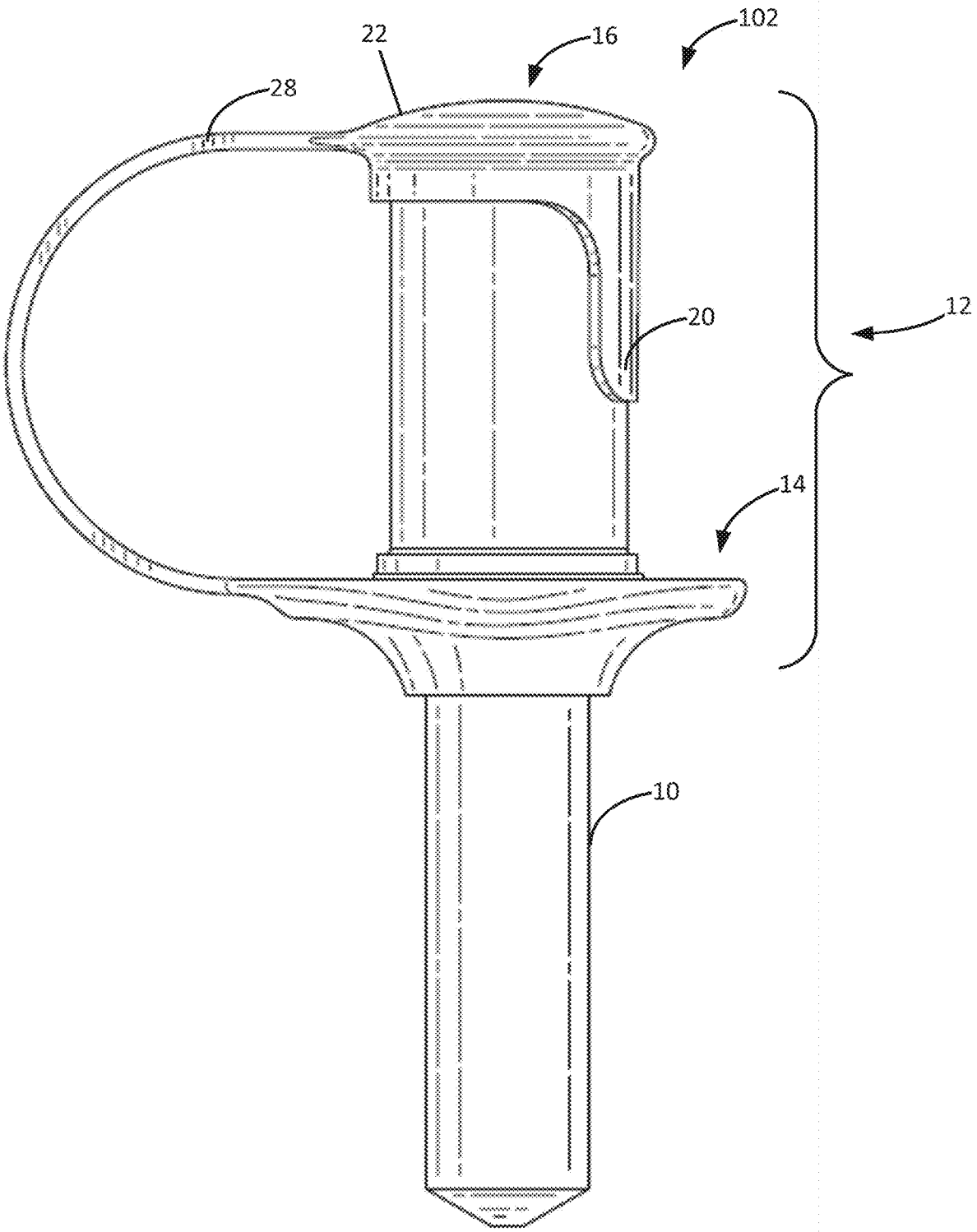
FIG. 14 is a left side view of the sample assembly shown in FIG. 10 according to some embodiments.
Figure 15:
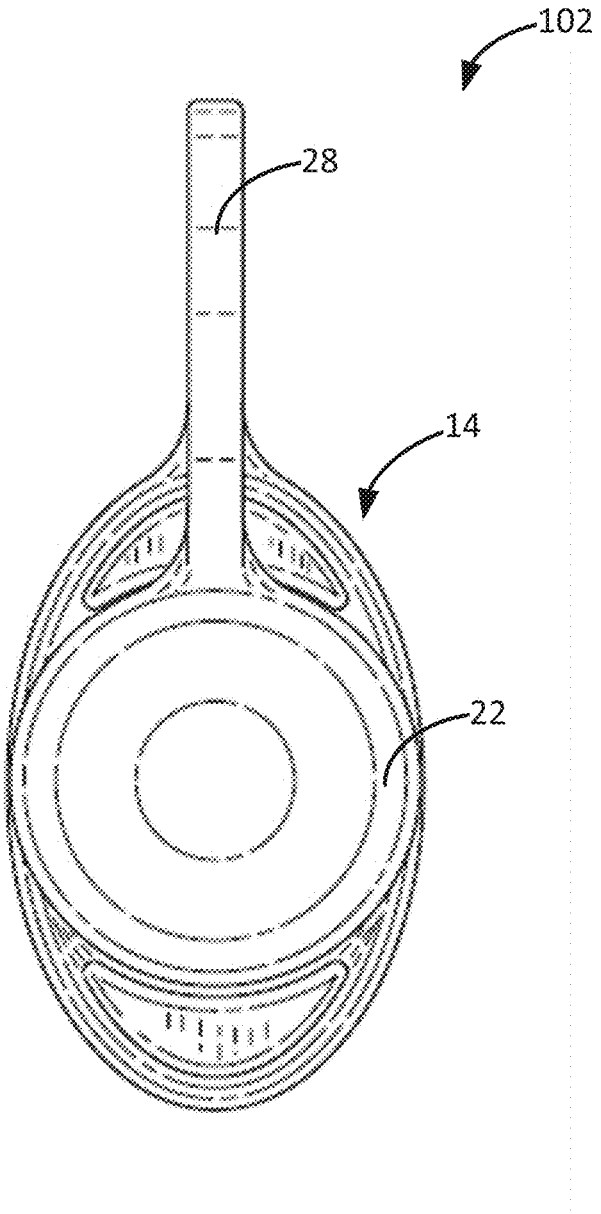
FIG. 15 is a top view of the sample assembly shown in FIG. 10 according to some embodiments.
Figure 16:
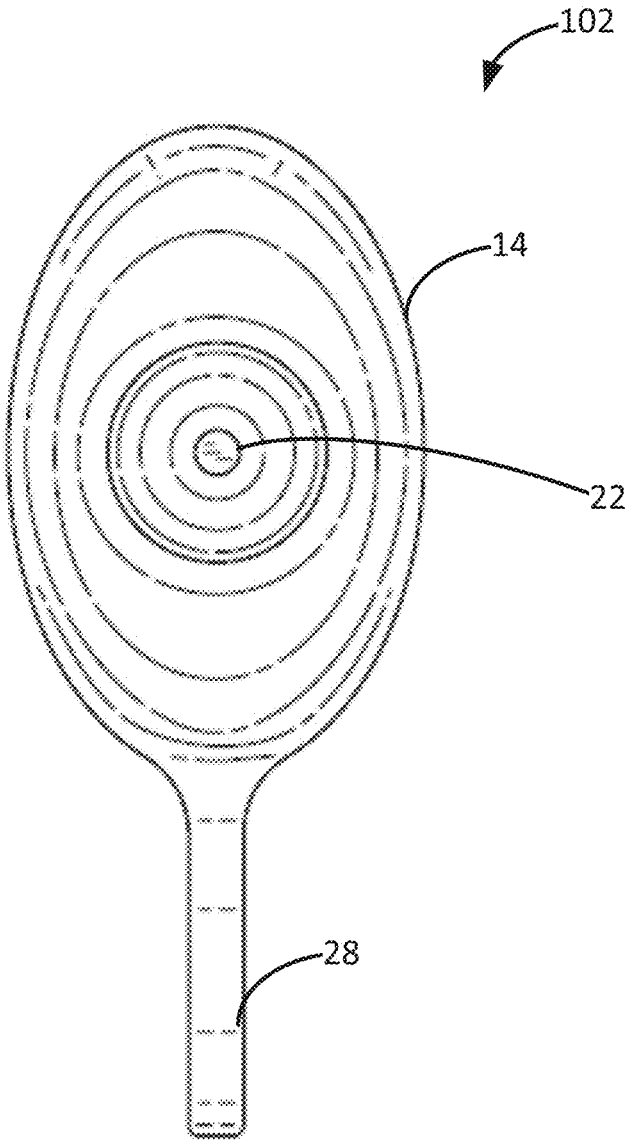
FIG. 16 is a bottom view of the sample assembly shown in FIG. 10 according to some embodiments.
Figure 17:
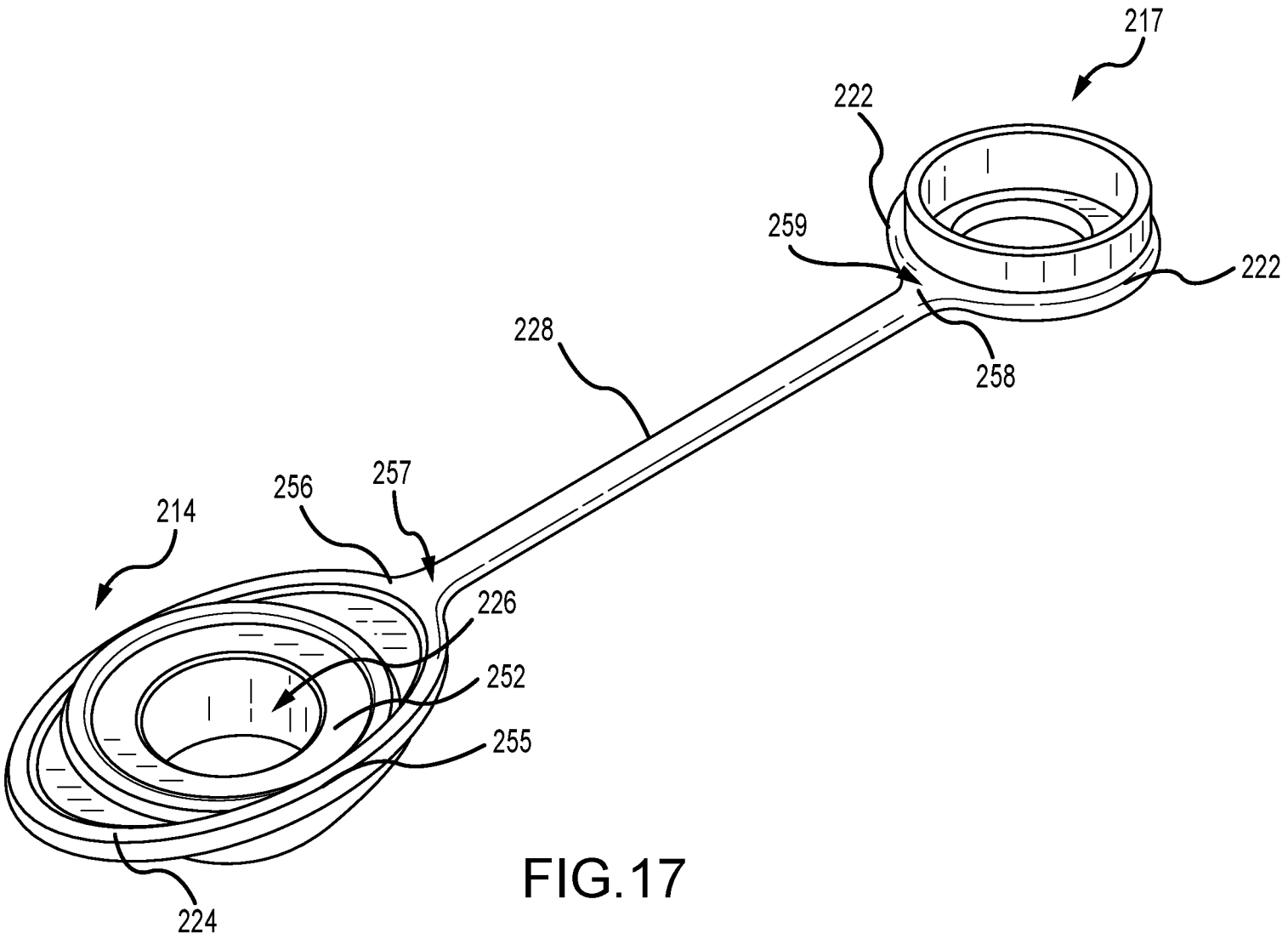
FIG. 17 is a perspective view of another embodiment of the sealing arrangement shown in FIG. 2 according to some embodiments.
Figure 18:
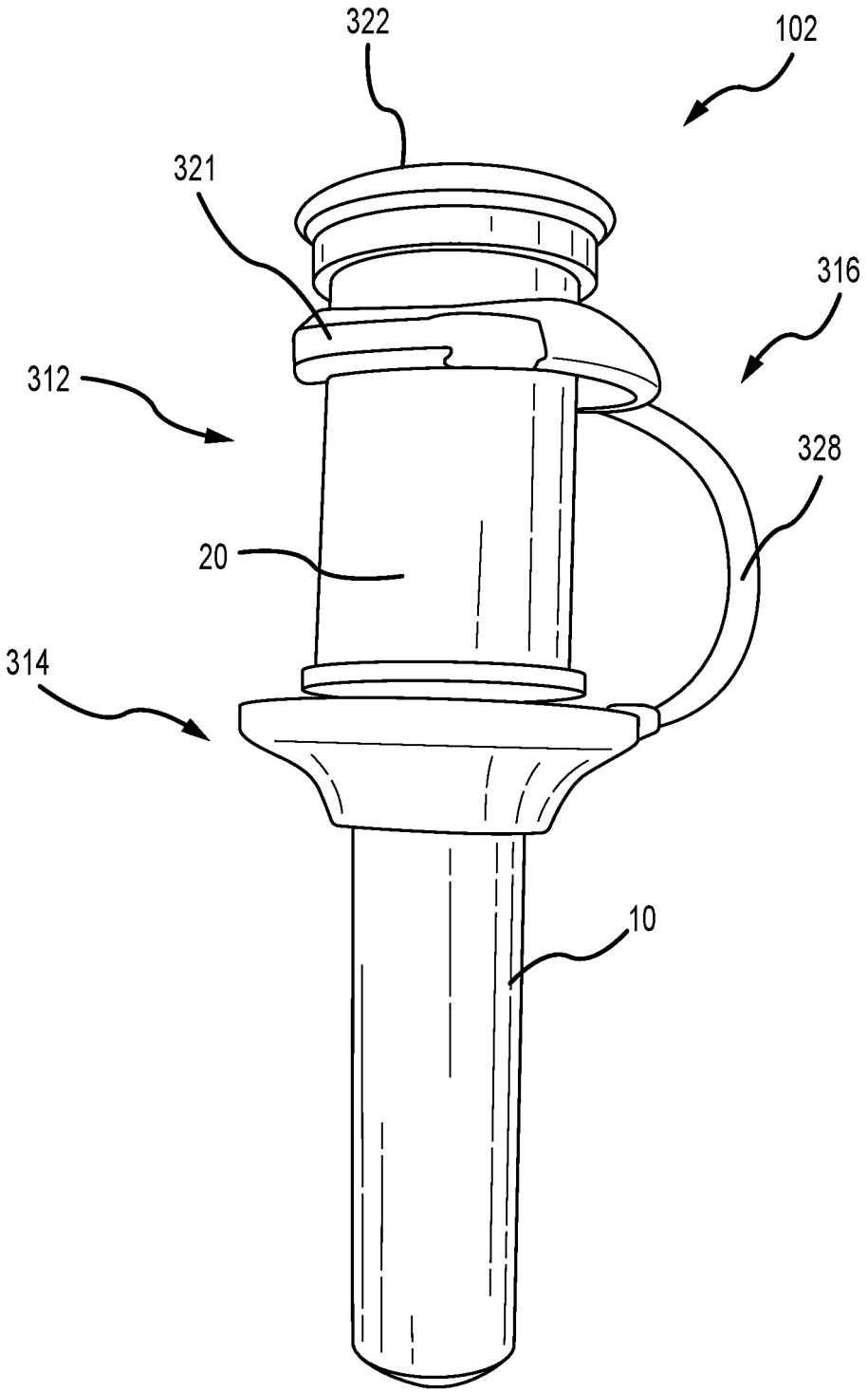
FIG. 18 is a perspective view of an embodiment of the sample assembly according to some embodiments.
Figure 19:
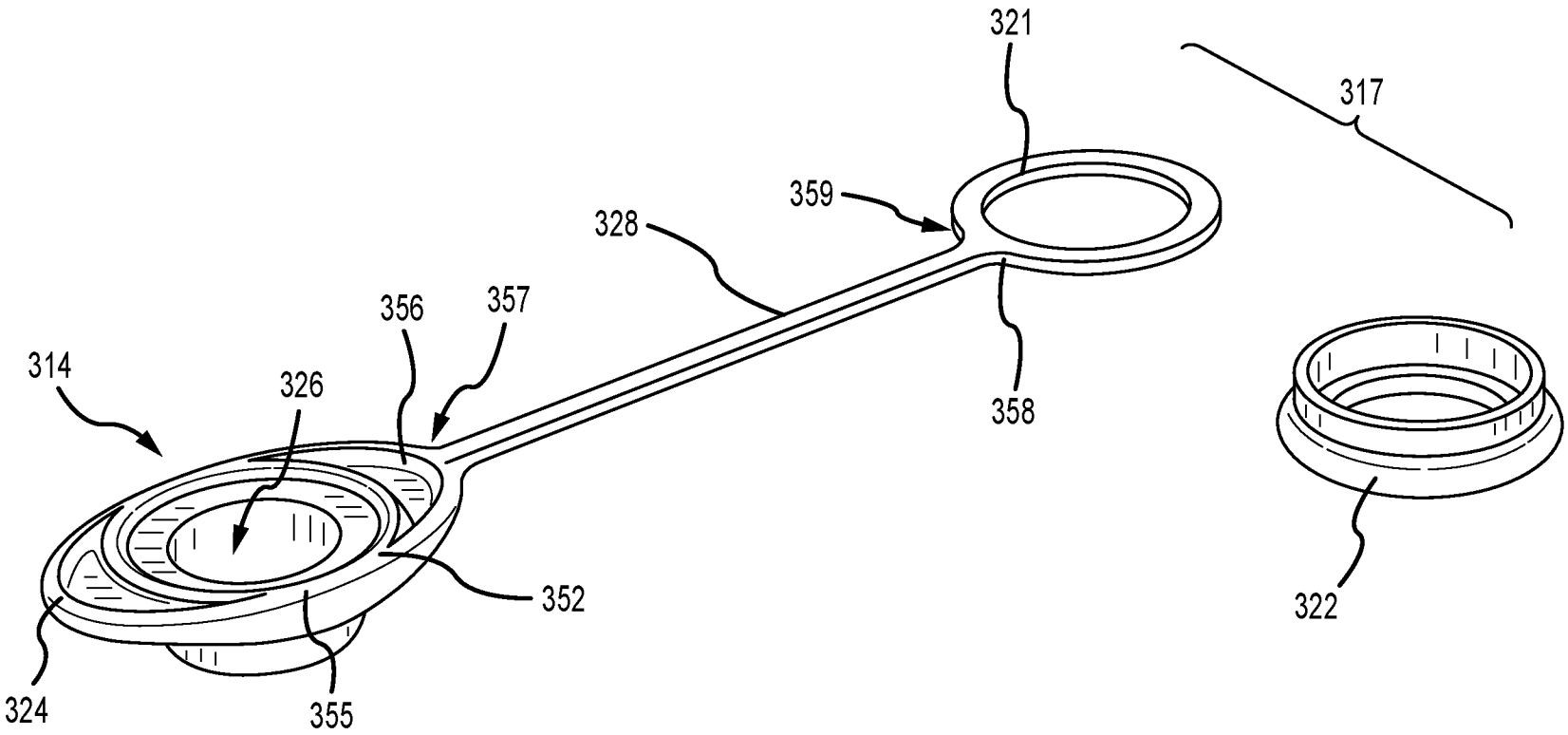
FIG. 19 is a perspective view of another embodiment of the sealing arrangement shown in FIG. 18 according to some embodiments.
Figure 20:
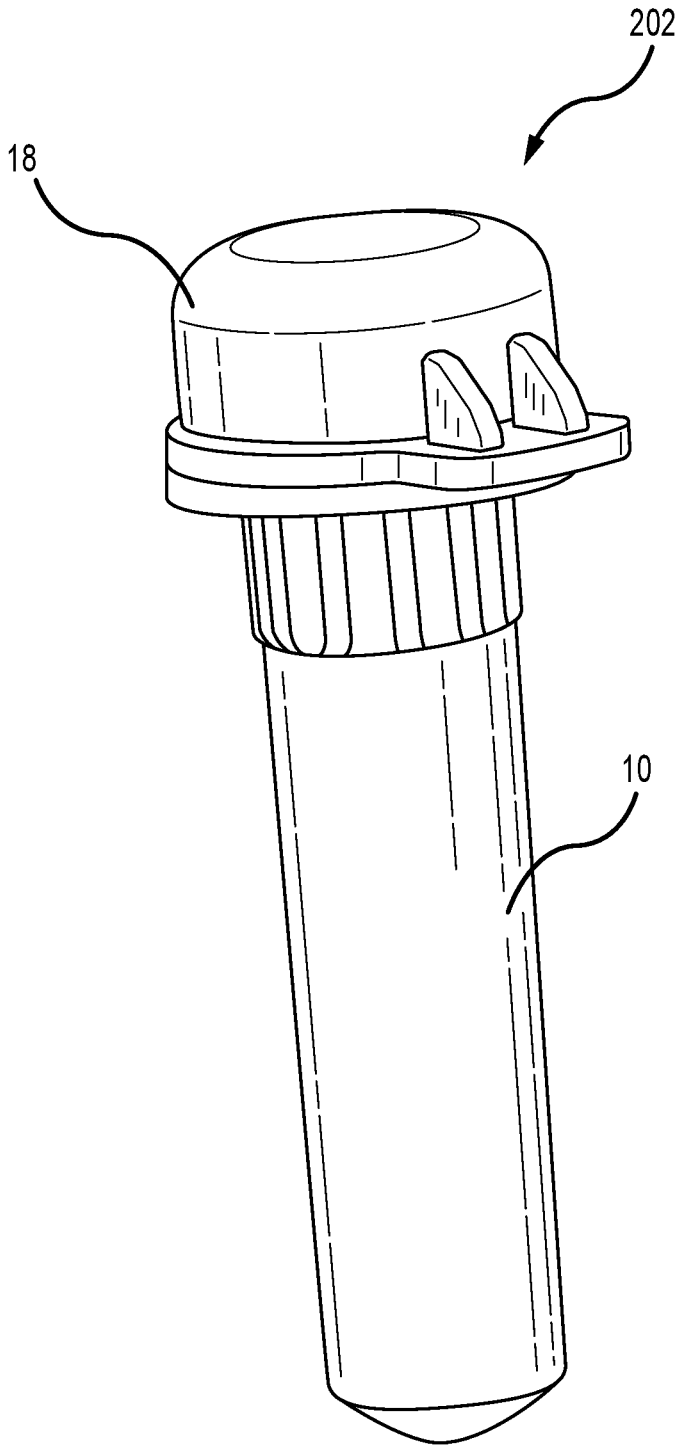
FIG. 20 is a perspective view of an embodiment of the sample assembly with a lab cap.

FIG. 2 is a perspective view of an embodiment of a sample assembly. FIG. 3 is an exploded view of the sample assembly shown in FIG. 2 according to some embodiments. FIG. 4A is a cross-sectional view of the sample assembly of FIG. 2 according to some embodiments. FIG. 4B is a cross-sectional view of the sample assembly of FIG. 2 according to some embodiments. FIG. 5A is a perspective view of a vial shown in FIG. 2 according to some embodiments. FIG. 5B is a translucent perspective view of the vial shown in FIG. 2 according to some embodiments. FIG. 6 is a perspective view of an embodiment of a sealing arrangement shown in FIG. 2 according to some embodiments. FIG. 7A is a perspective view of a desiccant cap shown in FIG. 2 according to some embodiments. FIG. 7B is a translucent perspective view of the desiccant cap shown in FIG. 2 according to some embodiments. FIG. 8 is a perspective view of a sample chamber shown in FIG. 2 according to some embodiments. FIG. 9A is a perspective view of a swab breaker according to some embodiments. FIG. 9B is a top view of a swab breaker according to some embodiments. FIG. 9C is a side view of a swab breaker according to some embodiments. FIG. 10 is a front perspective view of another embodiment of a sampling assembly. FIG. 11 is a front view of the sample assembly shown in FIG. 10 according to some embodiments. FIG. 12 is a rear view of the sample assembly shown in FIG. 10 according to some embodiments. FIG. 13 is a right side view of the sample assembly shown in FIG. 10 according to some embodiments. FIG. 14 is a left side view of the sample assembly shown in FIG. 10 according to some embodiments. FIG. 15 is a top view of the sample assembly shown in FIG. 10 according to some embodiments. FIG. 16 is a bottom view of the sample assembly shown in FIG. 10 according to some embodiments. FIG. 17 is a perspective view of another embodiment of the sealing arrangement shown in FIG. 10 according to some embodiments. FIG. 18 is a perspective view of an embodiment of the sample assembly according to some embodiments. FIG. 19 is a perspective view of another embodiment of the sealing arrangement shown in FIG. 18 according to some embodiments. FIG. 20 is a perspective view of an embodiment of the sample assembly with a lab cap. Unless otherwise noted, FIGS. 2-20 are discussed concurrently below.

The sample assembly 102 receives a sample from the user 101. Each component of the sample assembly 102 may be formed of different materials (e.g. glass, plastic, metal, etc.). The materials chosen for each component of the sample assembly 102 may allow for the sample to be securely contained within the sample assembly 102. In some embodiments, the sample assembly 102 may be formed of inert materials such as plastic (e.g. polypropylene) to ensure the integrity of the sample. The sample assembly 102 is typically sized to be hand held. In an example implementation, a length of sample assembly 102 is about three inches. Other sizes of sample assembly 102 are contemplated, such as, without limitation, lengths up to six inches, up to eight inches, or up to ten inches. Additionally, the sample assembly 102 may be configured to be inserted into standard testing equipment (e.g., a microfuge, other centrifuge, or liquid handling robot). Methods of use and manufacture are discussed below with reference to FIG. 21.

Referring to FIGS. 4*a* and 4*b*, the sealing arrangement 12 can form a sealed connection to the vial 10. In some instances, the sealing arrangement 12 forms a sterile barrier to the vial 10. The sealing arrangement 12 may receive a portion of the vial 10 and couple to the vial 10 such that a sealed connection interface 13 is formed between an exterior portion of the vial 10 and an interior portion of the desiccant cap 20. By mating the desiccant cap 20 to an exterior portion of the vial 10, a sealed connection can be formed while the vial 10 includes an insert, such as the sample chamber 34, which can extend beyond a horizontally extending rim 44 of the vial 10.

Referring to FIG. 3, the sealing arrangement 12 includes a coupling portion 14 and a cap assembly 16. The coupling portion 14 includes a ring portion 24 that defines a grip portion 25 and a mounting channel 26. The mounting channel 26 is sized and configured to receive a portion of the vial 10 as coupling portion 14 is selectively slid up or down vial 10. Horizontally extending rim 44 of vial 10 acts a stopping surface against which the ring portion 24 abuts. The grip portion 25 may be configured to be grasped by the user 101 while securing the sealing arrangement 12 to the vial 10. In other embodiments, the coupling portion 14 may be configured to thread, snap fit, etc., onto the vial 10.

The cap assembly 16 couples to the vial 10 to selectively form a sealed connection to the vial 10 that is a sterile barrier. As discussed in detail below, ASTM test F2338-09 may be used to determine whether the sealed connection between the sealing arrangement and the vial is a sterile barrier. The cap assembly includes a desiccant cap 20, a cap 22, a desiccant 30, and a small pore-sized disk 32. A cap portion (17 in FIG. 6, 217 in FIG. 17, and 317 in FIG. 19), may further be defined as the cap (22, 222, 322) having a cap periphery (58, 258). In some embodiments, the cap portion 317 (FIG. 19) may further include a connection loop 321 having a connection loop periphery 358. The connection loop 321 is formed separate from the cap 322 and may be positioned over the desiccant cap 20. The cap (22, 222, 322) may be coupled to the desiccant cap 20 (FIG. 2) or may be separate from the desiccant cap 20 (FIG. 3). A lanyard (28 in FIG. 6, 228 in FIG. 17, 328 in FIG. 19) may connect a ring portion periphery (56 in FIG. 6, 256 in FIG. 17) of the coupling portion (14 in FIG. 6, 214 in FIG. 17) and the cap periphery (58 in FIG. 6, 258 in FIG. 17). In some embodiments, the lanyard 328 may connect a ring portion periphery 356 of the coupling portion 314 and the connection loop periphery 358. As a result, the connection loop 321 may move along the desiccant cap 20 relative to the cap 322.

The connection of each component within the cap assembly 16 will be discussed in greater detail below. Broadly speaking, the desiccant 30 is configured to remove moisture from a sample the user 101 provides in the sample assembly 102. The small pore-sized disk 32 is configured to create a sterile barrier between the sample and the desiccant 30. The desiccant 30, therefore, may not have to be sterilized to create the sterile chamber for the sample.

The vial 10 couples to the sealing arrangement 12 to secure the sample provided by the user 101. Vial 10 is configured to receive a vial insert. Example vial inserts include any combination of sample chamber 34 (FIG. 4*a*), a swab breaker assembly 68 (FIGS. 9A-C), or a matrix 61 (FIG. 4*b*). In one embodiment, the example vial insert may include the sample chamber 34. In another embodiment, the example vial insert may include the sample chamber 34 with the matrix 61 positioned within the sample chamber 34. In another embodiment, the example vial insert may include the sample chamber 34 with the swab breaker 68 positioned within the sample chamber 34. In another embodiment, the example vial insert may include the sample chamber 34 with the matrix 61 and the swab breaker 68 positioned within the sample chamber 34. In another embodiment, the example vial insert may include the swab breaker 68. In another embodiment, the example vial insert may include the swab breaker 68 with the matrix 61 positioned within the sample chamber 34.

Referring to FIGS. 5A and 5B, the vial 10 includes a first end 36, a second end 38, and a sidewall extending 39 between the first end 36 and the second end 38. The first end 36 of the vial 10 defines an opening 42. Second end 38, further includes a pointed end. In other implementations, the second end 38 may include a rounded end or a flat end. Opening 42 can be configured to receive a sample chamber 34, discussed in greater detail below.

The horizontally extending rim 44 extends outwardly from the opening 42 of the vial 10. A vertically extending rim 46 extends upwardly from the horizontally extending rim 44. A first ledge 50 is formed between the vertically extending rim 46 and the opening 42. The vertically extending rim 46 may also include an upper vial ledge 48. Broadly speaking, the horizontally extending rim 44 and the vertically extending rim 46 enable the sealing arrangement 12 to couple to the vial 10. In other embodiments, the vial 10 may be constructed to have an inner threaded portion, outer threaded portion, or any other configuration that allows the sealing arrangement 12 to be coupled to the vial 10.

The vial 10 includes internal vial grooves 49 disposed on the inside surface of vial proximate to the opening 42 of the vial and external vial grooves 47 disposed on an outside surface of the vial proximate to the horizontally extending rim 44. The internal vial grooves 49 enable sterilization of the vial with a vial insert positioned in the vial. The external vial grooves 47 provide a frictional fit with the sealing arrangement 12 to provide a secure coupling of the vial and the sealing arrangement 12. The vial grooves (47, 49) can be configured to comply with ISO 18385 standards to ensure that the vial is sterile or DNA free after one or more sterilization procedures. In other embodiments, the vial grooves (47, 49) may be positioned anywhere on the vial that allows sterilization to occur.

Referring to FIGS. 4*a* and 4*b*, the sample chamber 34 is a removable component that receives a sample from the user 101 and is capable of use in lab testing equipment. The sample chamber 34 includes a coupling ledge 54 that contacts an inner portion of the horizontally extending rim 44 of the vial 10. The sample chamber 34 includes a first end 63 forming a bottom portion and a second end 71 having an opening. In some embodiments, the first end 63 may include a solid bottom portion with weak areas (e.g., areas with reduced thickness) that break when the sample is being processed (e.g., processing the sample using centrifugation, vacuum, etc.). When the weak areas of the first end 63 break, the sample may exit the sample chamber and be forced into the vial 10. In other embodiments, the sample chamber 34 may include apertures arranged in a grid-like pattern to separate solid components from liquid components of the sample.

In some embodiments, as shown in FIG. 4*b*, the sample chamber 34 may include a matrix 61 (illustrated schematically in FIG. 4*b*) positioned adjacent the first end 63 of the sample chamber 34. The matrix 61 is constructed to separate and attract or capture different components of the sample (e.g., sperm, proteins, etc.) as the sample is processed. For example, matrix 61 may separate the sperm and DNA using a single layer or multilayer filter or mesh including inert materials (e.g., polyethersulfone, modified nylon polypropylene). The filter or mesh may include apertures having a diameter or size of approximately two to six micrometers (μM). In some constructions, the matrix 61 may include thicker inert material with antibodies that attract the antigens found on the surface of sperm. The matrix 61 may be constructed to have any height and diameter to fit within the vial insert (e.g., sample chamber 34, swab breaker 68, etc.).

In some embodiments, the matrix 61 is secured within the sample chamber 34 adjacent the first end 63 that holds the sample being processed. The first end 63 of the sample chamber 34 may be collapsible when the sample is being centrifuged. When the first end 63 collapses (e.g., the weak areas break), the sample is forced through the matrix 61. The matrix 61 captures components from the sample (e.g., sperm, proteins, etc.) and allows any liquid in the sample chamber 34 to escape to the bottom of the vial 10.

In the illustrated construction, the matrix 61 has a diameter of approximately ½ inch. The matrix may be held in place within the sample chamber 34 by a first compressed ring 69 positioned adjacent the first end 63 of the sample chamber 34 and a second compressed ring 70 positioned adjacent a second end 71 of the sample chamber 34. The first and second compressed rings 69, 70 may formed of polypropylene or other inert material. The second compressed ring 70 may have a diameter slightly larger than the diameter of the sample chamber 34 (e.g., larger than approximately ½ inch) and the first compressed ring 69 may have a diameter approximately the same size as the sample chamber 34. As a result, the matrix 61 may form a friction coupling with the sample chamber 34 when the matrix 61 is inserted within the sample chamber 34. In some implementations, the sample chamber 34 is positioned within and couples to the vial 10.

Referring to FIGS. 9A, 9B, and 9C, swab breaker 68 is another vial insert that can be used in place of sample chamber 34 or as part of the sample chamber 34. Additionally, the swab breaker 68 may include a matrix 61 as described above. The swab breaker 68 may be positioned in and coupled to the vial 10. The swab breaker 68 includes a coupling ledge 154. The swab breaker 68 could have an open or closed basket end 72 with one or more protrusions 74. The one or more protrusions 74 are configured to receive a swab from the user 101. The user 101 may break a handle of the swab to secure the sample within the swab breaker 68. The swab breaker 68 may further restrict the movement of certain materials through the basket end 72.

Referring to FIG. 6, an embodiment of the coupling portion 14 and the cap portion 17 is shown. The coupling portion 14 includes the ring portion 24 that first defines a second ledge 52 and a ring portion periphery 56. When the vial 10 is positioned within the mounting channel 26, a friction coupling between the external groove 47 (FIG. 5A) of the vial 10 and the mounting channel 26 is formed. As a result, the second ledge 52 abuts the first ledge 50 of the vial 10 to restrict motion of the coupling portion 14 relative to the vial 10. In other embodiments, the coupling portion 14 may be secured with threads, snap fit, etc.

With continued reference to FIG. 6, the ring portion 24 defines a ring portion periphery 56. The ring portion 24 includes two opposing wide end portions 53 and two opposing narrow end portions 55. The two opposing wide end portions 53 and the two opposing narrow end portions 55 further defines an oval cross section of the ring portion 24. In other embodiments, a cross section of the ring portion 24 may be circular, square, rectangular, etc. The ring portion periphery 56 is connected to a first end of a lanyard 28 which defines a first connection area 57. The cap assembly 16 includes, among other things, the cap 22. The cap 22 defines a cap periphery 58. The cap periphery 58 is connected to a second end of the lanyard 28 and defines a second connection area 59.

The lanyard 28 is configured allow the cap assembly 16 to remain coupled to the sample assembly 102 when the user 101 to detaches the cap assembly 16 from the vial 10. The first connection area 57 and second connection area 59 are configured to include a tapered feature to increase flexibility around the first and the second connection area. In other embodiments, sample assembly 102 may not include a lanyard 28.

FIG. 17 illustrates a coupling portion 214 and a cap portion 217 according to another embodiment. The coupling portion 214 and the cap portion 217 is similar to the coupling portion 14 and the cap portion 17 described above, and the following description focuses primarily on differences between the coupling portion 214, cap portion 217, coupling portion 14, and cap portion 17. In addition, features and elements of the coupling portion 214 and the cap portion 17 correspond to features and elements of the coupling portion 14, and cap portion 17 are given like reference numbers.

A periphery of the ring portion 256 is connected to a first end of a lanyard 228 which defines a first connection area 257. A periphery of the cap 258 is connected to a second end of the lanyard 228 and defines a second connection area 259. The first connection area 257 and the second connection area 259 are configured to include a flat portion to aid in the storage and packaging of the coupling portion 214, the lanyard 228, and the cap assembly. In other embodiments, the lanyard may be constructed of other material (e.g. wire, rope, etc.) that improves the storage and packaging of the coupling portion, the lanyard, and the cap assembly.

FIGS. 18 and 19 illustrate a coupling portion 314 and a cap portion 317 according to another embodiment. The coupling portion 314 and the cap portion 317 is similar to the coupling portion 14 and the cap portion 17 described above, respectively, and the following description focuses primarily on differences between the coupling portion 314, cap portion 317, coupling portion 14, and cap portion 17.

The cap portion 317 includes a cap 322 and a connection loop 321 formed separate from each other. A periphery of a ring portion 356 of the coupling portion 314 is connected to a first end of a lanyard 328 and a periphery of the connection loop 358 is connected to a second end of the lanyard 328. Since the lanyard 328 is only connected to the connection loop 321, the connection loop 321 may move independently from the cap 322. For example, the connection loop 321 may be positioned over the desiccant cap 20 before the cap 322 is secured to the desiccant cap 20 (e.g., by spin welding the cap 322 to the desiccant cap 20). Once the cap 322 is secured to the desiccant cap 20, the connection loop 321 may slide between a bottom lip of the desiccant cap 20 and the cap 322 without sliding off the desiccant cap 20.

The desiccant cap 20 couples to vial 10 to selectively seal the sample assembly 102. Referring to FIGS. 7A and 7B, the desiccant cap 20 includes a desiccant cap first end 60, a desiccant cap second end 62, a lattice 64, and a desiccant Cap chamber 66. The desiccant cap first end 60 and the desiccant cap second end 62 each include an opening. In other embodiments, the desiccant cap first end 60 and the desiccant cap second end 62 may be closed. The lattice 64 is positioned proximate to the desiccant cap second end 62. The lattice 64, therefore, defines the desiccant cap chamber 66 as the area between the desiccant cap first end 60 and the lattice 64.

The desiccant cap first end 60 includes a first desiccant ledge 65. The cap 22 is configured to couple to the first desiccant ledge 65 of the desiccant cap first end 60. The cap 22 is welded to the first desiccant ledge 65. In other embodiments, the cap 22 may be glued, press fit, etc., in order to form a secure connection.

The desiccant cap second end 62 includes a second desiccant ledge 67. The upper vial ledge 48 is configured to couple to the second desiccant ledge 67 of the desiccant cap second end 62. The coupling of the second desiccant ledge 67 and the desiccant cap second end 62 produces the sealed barrier interface, shown most clearly in FIG. 4. In other embodiments, the desiccant cap second end 62 may include other releasable type connection methods that are configured to couple to the vial 10.

The lattice 64 is configured to allow air flow to pass through a plurality of channels defined by the lattice 64. The lattice 64 may be positioned anywhere between the desiccant cap first end 60 and the desiccant cap second end 62 while still defining a desiccant cap chamber 66 sized to receive desiccant 30. The small pore-sized disk 32 may be received within the desiccant cap chamber 66 and may also be coupled to lattice bottom 64 to create the sterile barrier mentioned earlier. In an example implementation, during cap assembly, the desiccant 30 is positioned in the desiccant cap chamber 66 before the cap 22 is connected to the desiccant cap 20.

FIG. 20 illustrates a sample assembly 202 including a lab cap 18. The lab cap 18 couples to the vial 10. The sample assembly 202 may be assembled when the sealing arrangement 12 is removed from the sample assembly 102. In some embodiments, the sealing arrangement 12 may be removed when the sample assembly 102 is in the testing lab 103. The sample assembly 202 may be used with standard laboratory equipment.

In an example implementation, a user can receive a sample container including a sample assembly 102 as described above. The sample container can be configured to be shipped or transmitted by a postal service. In some instances, the sample container includes a lid, a matrix and a holding tray. Each of the vial, sample chamber, and sealing arrangement may be pre-assembled. If not, the user takes the vial and slides the sealing arrangement onto the vial. Before or after that, the user can position the sample chamber within the vial. The holding tray can include a holding slot and the user can position the sample assembly upright in the holding slot. After obtaining the sample, the user positions the sample in the sample chamber and then seals the assembly by closing a cap assembly onto the vial. Next, the user can transport the sample assembly to a lab for testing, such as by mailing or shipping the whole sample container.

Figure 21:
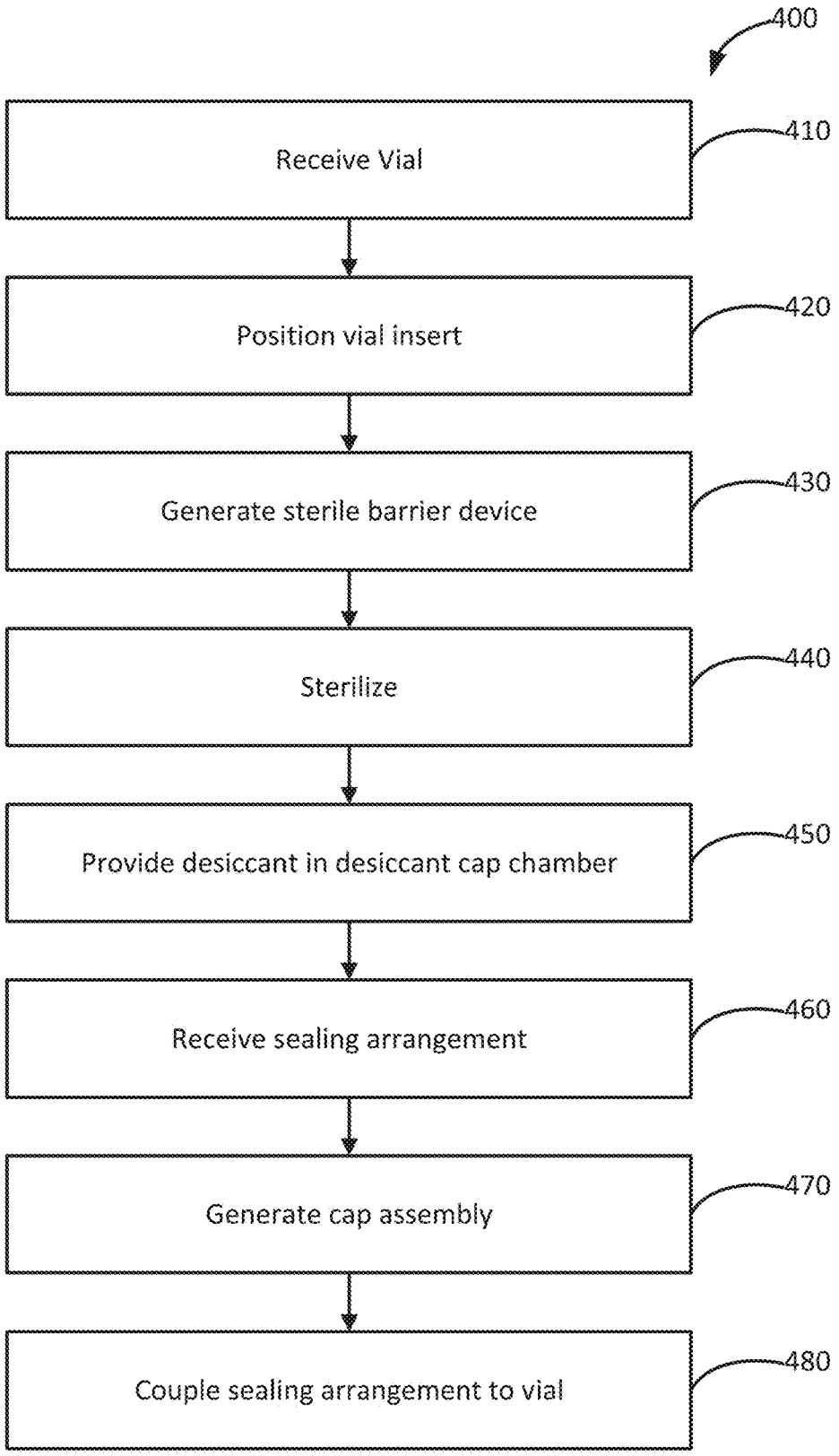
FIG. 21 is a flow chart of a method of assembling a sample assembly according to some embodiments.

FIG. 21 shows an example method 400 of assembling the sample assembly 102 disclosed above. During the method of assembling the sample assembly 102, components may be received from an external source (e.g. a manufacturer of vials) or the components may be manufactured by the assembler.

Method 400 begins by receiving a vial 10 (operation 410). A vial insert is positioned within the vial 10 (operation 420). The vial insert can be any combination of sample chamber 34, a matrix 61, or swab breaker 68 or other insert that fits within the vial. In some embodiments, the matrix 61 may be provided within the vial insert to separate and capture different components of a sample when the sample is being processed.

The small pore-sized disk 32 is connected to a lattice 64 of the desiccant cap 20 to generate a sterile barrier device (operation 430). In some instances, small pore-sized disk 32 is heat stamped to lattice 64.

Next, sterilizing is performed (operation 440). The vial 10, the sample chamber 34, and the sterile barrier device can be sterilized with ethylene oxide to ensure a sterile chamber. In other embodiments, any other sterilizing medium that ensures sterility or that a sterile chamber was produced may be used. In some embodiments, the vial 10 is coupled to the sterile barrier device to form a seal and after coupling the vial 10 to the sterile barrier device, the vial 10 is sterilized using internal grooves 49 on the vial 10. Additionally, more components of the sample assembly 102 may be sterilized.

After sterilization, an appropriate number of samples can be sent for testing. For example, ASTM F2338-09 may be used to test the integrity of the connection (e.g., the heat stamping) between the small pore-sized disk 32 and the lattice 64 in the bottom of the desiccant cap chamber 66. The ASTM F2238-09 test is a standard test method for nondestructive detection of leaks in packages by vacuum decay method. The test can be used to ensure that there is a seal between the disk 32 and the lattice 64 of the desiccant cap 20 and that a sterile barrier is formed in the desiccant cap chamber 66. In other embodiments, other standard testing procedures may be used to ensure that a sterile barrier is formed in the bottom of the desiccant cap chamber 66.

Next, the desiccant 30 is provided into the desiccant cap chamber 66 (operation 450). The desiccant 30 does not need to be sterilized since a sterile barrier is in place to maintain the sterility of the vial contents. The sealing arrangement 12 including the coupling portion 14 and the cap 22 is received (operation 460).

After providing the desiccant 30 into the desiccant cap chamber 66, the sterile barrier device is coupled to the cap 22. The cap assembly 16 is generated (operation 470). The sealing arrangement 12 is coupled to the vial 10 (operation 480). The sample assembly 102 is assembled.

What is claimed is:

1. A sample assembly comprising:

a vial defining an internal chamber configured to receive a vial insert;

a sealing arrangement including a coupling portion and a cap assembly, the coupling portion defining a mounting channel sized to receive a portion of the vial;

the coupling portion configured to slidably couple to the vial; and the cap assembly including a desiccant cap, the desiccant cap comprising a desiccant cap first end, a desiccant cap second end, a desiccant cap chamber defined between the desiccant cap first and second ends, and a desiccant positioned within the desiccant cap chamber, the desiccant cap being configured to couple to the vial to selectively form a sterile barrier between the sealing arrangement and the vial, wherein the desiccant is positioned above the vial insert and the internal chamber of the vial, wherein the vial insert is positioned within the vial and the vial insert being any combination of a sample chamber, a swab breaker assembly, or a matrix, wherein the matrix further comprises a first compressed ring and a second compressed ring, wherein the first compressed ring is positioned adjacent a first end of the vial insert and the second compressed ring is positioned adjacent a second end of the vial insert to secure the matrix within the vial insert, wherein the matrix is configured to separate and capture different components of a sample.

2. The sample assembly of claim 1, wherein the coupling portion includes a ring portion, wherein the ring portion defines the mounting channel for receiving the vial and a grip portion configured to be grasped by a user.

3. The sample assembly of claim 2, the sealing arrangement further comprising a lanyard, the ring portion further comprising a ring portion periphery, the cap assembly further comprising one or more of a cap defining a cap periphery and a connection loop defining a connection loop periphery; and the lanyard being connected to the ring portion periphery and the connection loop periphery or the lanyard being connected to the ring portion periphery and the cap periphery.

4. The sample assembly of claim 3, the ring portion having two opposing wide end portions and two opposing narrow end portions.

5. The sample assembly of claim 4, the lanyard being connected to a narrow end portion.

6. The sample assembly of claim 1, wherein the desiccant cap has a lattice positioned proximate to the desiccant cap second end;

wherein the desiccant cap chamber is defined between the desiccant cap second end and the lattice, wherein a small pore-sized disk is coupled to the lattice to restrict bacteria from entering a sterile chamber.

7. The sample assembly of claim 1, wherein the cap assembly includes a cap configured to be coupled to a first desiccant ledge of the desiccant cap first end.

8. The sample assembly of claim 1, the sample assembly further comprising a lab cap, the lab cap being configured to couple to the vial when the sealing arrangement is in an uncoupled position.

9. The sample assembly of claim 1, the vial further comprising internal vial grooves disposed on an inside surface of the vial proximate to an open end of the vial, the internal vial grooves being configured to enable sterilization with the vial insert positioned within the vial.

10. The sample assembly of claim 1, the vial further comprising external vial grooves disposed on an outside surface of the vial proximate to a horizontally extending rim of the vial, the external vial grooves being configured to provide a frictional fit with the sealing arrangement.

* * * * *